United States Patent [19]

Pfefferkorn et al.

[11] 3,931,659

[45] Jan. 13, 1976

[54] FLOOR TREATING MACHINE

[75] Inventors: Kurt Pfefferkorn, Wallisellen, Zurich; Charles Sérou, Opfikon-Glattbrugg, Zurich both of Switzerland

[73] Assignee: Diethelm AG, Zurich, Switzerland

[22] Filed: June 24, 1974

[21] Appl. No.: 482,096

[30] Foreign Application Priority Data

June 28, 1973 Austria ..... 5705/73

[52] U.S. Cl. ..... 15/49 R; 15/246

[51] Int. Cl.[2] ..... A47L 11/162

[58] Field of Search ..... 15/49 R, 50 R, 51, 52, 15/98, 246, 385

[56] References Cited

UNITED STATES PATENTS

| | | | |
|---|---|---|---|
| 2,221,315 | 11/1940 | Okun | 15/49 R X |
| 3,798,697 | 3/1974 | Lowder et al. | 15/49 R |

*Primary Examiner*—Edward L. Roberts

*Attorney, Agent, or Firm*—Werner W. Kleeman

[57] ABSTRACT

A floor treating machine supported at the floor or surface to be treated by means of a work disk arranged beneath a substantially ring-shaped stop member, the work disk being detachably coupled with a drive motor. There are provided two selectively insertable work disks of different diamter and a ring-shaped stop member is provided for each such work disk.

7 Claims, 3 Drawing Figures

FLOOR TREATING MACHINE

BACKGROUND OF THE INVENTION

The present invention relates to a new and improved construction of floor treating or cleaning machine, hereinafter conveniently referred to as a floor treating machine, such machine being of the type which is supported at the floor or surface to be treated by means of a work disk which is arranged beneath a substantially ring-shaped stop member and releasably coupled with a drive motor.

Floor treating machines of such type are employed for the most varied work, such as, for instance, for polishing, buffing, wiping, scrubbing, sanding, grinding, planing, spraying (with chemical agents) and so forth. These prior art floor treating machines can be basically classified into two groups, namely a first group which is employed for the thorough floor treating work and a second group employed for the maintenance work. Consistent with such subdivision there have been constructed for many years heavy, high-output floor treating machines for the thorough cleaning work and lighter, less powerful machine constructions for the maintenance cleaning work. The most commonly employed models are typically equipped with a work disk having a diameter of about 400 millimeters. Satisfying the requirements which prevail owing to the nature of the work which must be accomplished by resorting to the available equipment heretofore known in the art is extremely uneconomical and for years has only constituted a continual emergency solution. This can be already best appreciated from the aspect of the manufacturer of such equipment, since the production of two different types of machines results in smaller mass production and accordingly higher costs for each unit. Of perhaps even greater significance are the drawbacks considered from the standpoint of the user of such machine, particularly if it is appreciated that the thorough floor cleaning or treatment work —in contrast to the daily maintenance cleaning work— occurs at larger time intervals, possibly only once each year, with the result that the more expensive floor treating machine used for the thorough cleaning work is hardly used and therefore uneconomically employed.

Up to the present the manufacturers of such equipment have not been able to find a satisfactory solution for this problem and to offer one to the consumer. One proposal which has been made and commercialized relates to a two-speed machine which is operated at a lower rotational speed during the thorough cleaning work and at a higher rotational speed during the maintenance cleaning work. But with this solution, of course, the machines are more complicated and expensive, without really providing any increased advantages in terms of the more expensive costs of the equipment. In fact it has been found that the higher rotational speed only provides better utilization of the motor output which has been designed on the basis of the thorough cleaning work over a partial range of the maintenance work, not however over the entire range of maintenance work. Apart from the foregoing it has been found to be a further extremely disadvantageous factor that the correct selection of the rotational speed (for the purpose of optimumly utilizing the power of the motor) is extensively dependent upon the skill and "feeling" of the operator and improperly selected rotational speeds can lead to disturbances in the operation of the equipment. Due to these drawbacks preference has generally persisted for the single-speed machines.

Moreover, in an attempt to avoid the necessity of procuring two machines the users of such equipment have acquired bad habits. For instance, it has been found that the workers have used the machine intended for the thorough cleaning or treating work also for the maintenance cleaning work or, however, as more frequently was the case, the maintenance cleaning machine once per year for the heavy or thorough cleaning work and which last-mentioned type of work was much too rigorous for use with the maintenance cleaning machine. In the first case there existed on a daily basis loss in drive energy, whereas in the second case the machine was actually overloaded and thus either immediately or during the course of time broke down.

SUMMARY OF THE INVENTION

Hence, from what has been discussed above it should be apparent that this particular field of technology is still in need of floor treating machine constructions not associated with the drawbacks and limitations discussed above. It is therefore a primary object of the present invention to provide a new and improved construction of floor treating machine which satisfactorily fulfills the existing need in the art and is not associated with the aforementioned drawbacks and limitations of the prior art proposals.

Another and more specific object of the present invention aims at the provision of a floor treating machine which does not constitute a compromise solution as was heretofore the case and is capable of optimumly carrying out both types of work.

Still a further significant object of the present invention relates to an improved floor treating machine which is relatively simple in construction and design, extremely reliable in operation, quite versatile, and specifically adaptable for carrying out both thorough cleaning work as well as maintenance cleaning work.

Now in order to implement these and still further objects of the invention, which will become more readily apparent as the description proceeds, the invention is manifested by the features that there are provided two selectively insertable work disks of different diameter and for each such work disk there is provided a ring-shaped or ring stop. Thus, the given drive power which is dimensioned for the thorough cleaning work by means of the smaller diameter disk is applied to the floor by the larger size work disk with a specific power per unit surface adequate for the maintenance cleaning work and with an enlarged working range, and accordingly, can be fully utilized for the maintenance cleaning work. In contrast to the non-useful increase of the rotational speed undertaken with regard to the aspect of increasing the output, in this case the output or power of the machine is really increased by increasing the useful working range and by daily usefully employing the machine expenditure predicated upon the requirements of the thorough or primary cleaning work. A comparison with the two-speed machine has shown that additionally the floor treating machine of this development, when used in both of its useful stages, not only is properly dimensioned from the standpoint of the power requirements but additionally also with respect to its construction. Thus, while the heretofore known reversible machines when operating in the higher rotational speed range function with an overdimensioned transmission or gearing, the requirements which are placed upon the gearing or transmission of the machine of this development are approximately the same both for the thorough cleaning work as well as also for the maintenance cleaning work. Apart from the economies regarding energy which are realized the machine of the invention also from its constructional standpoint is devoid of any compromise solutions. This means that the apparent advantages which are gained by both the user as well as the manufacturer are not overpaid. The manufacturer can adequately satisfy the requirements with a single type of machine and therefore can produce such machines less expensively on a mass-production basis. On the other hand, the users of such equipment obtain two machines in one merely for the small additional cost of providing an additional work disk and the therewith associated ring stop.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
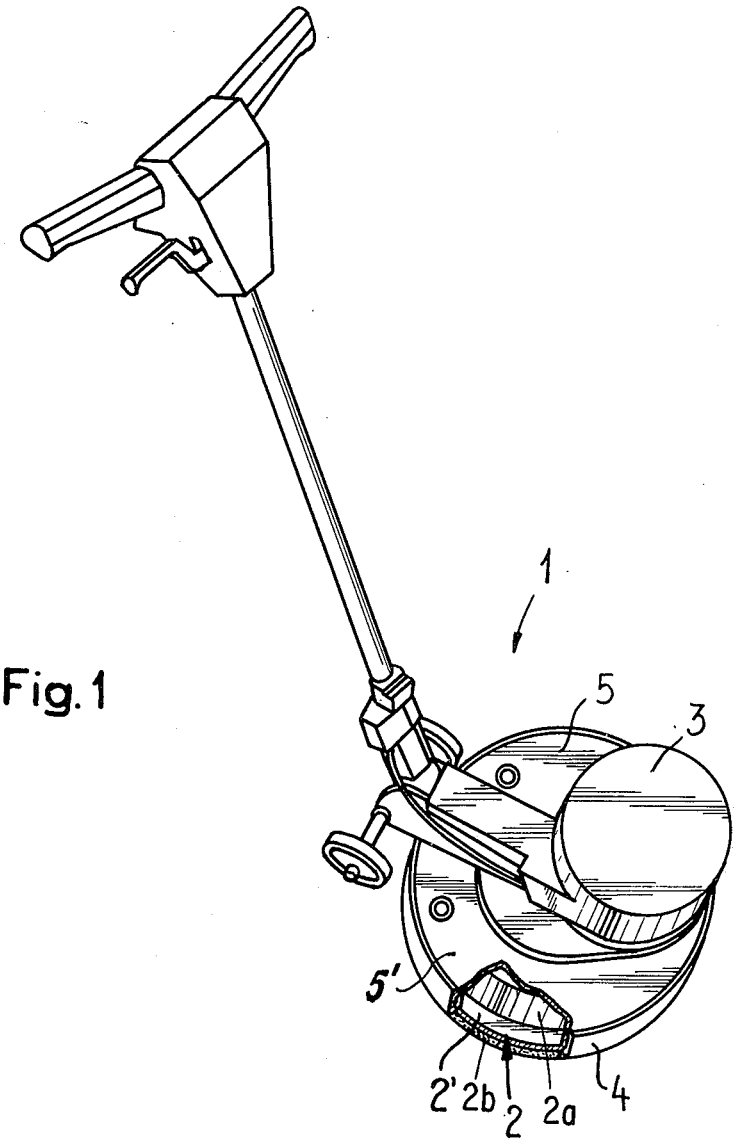
FIG. 1 is a perspective view of a floor treating machine employed for the primary or thorough floor cleaning work.

Describing now the drawings, according to the exemplary embodiment of floor treating machine shown in FIG. 1 the entire floor cleaning machine, conveniently designated by reference numeral 1, rests upon a work disk 2 which is conveniently driven by a suitable drive motor 3 through the agency of an appropriate detachable coupling which is not particularly visible in the showing of the drawing. The work disk 2 is detachably connected by means of the detachable or releasable coupling to the drive motor 3 in conventional manner which does not constitute part of the invention. As to the work disk 2, and as best seen by referrring to FIG. 1, such comprises a marginal edge or rim 2' from which upwardly extends a central hood portion 2*a*. At the underside of the marginal edge or rim 2' of the work disk 2 there is supported a suitable floor treating element 2*b*. Above the marginal edge or rim 2' of the work disk 2 there is located a stop or check ring 4 which is secured to a substantially plate-shaped wall portion 5 of the machine housing 5'.

Figure 2:
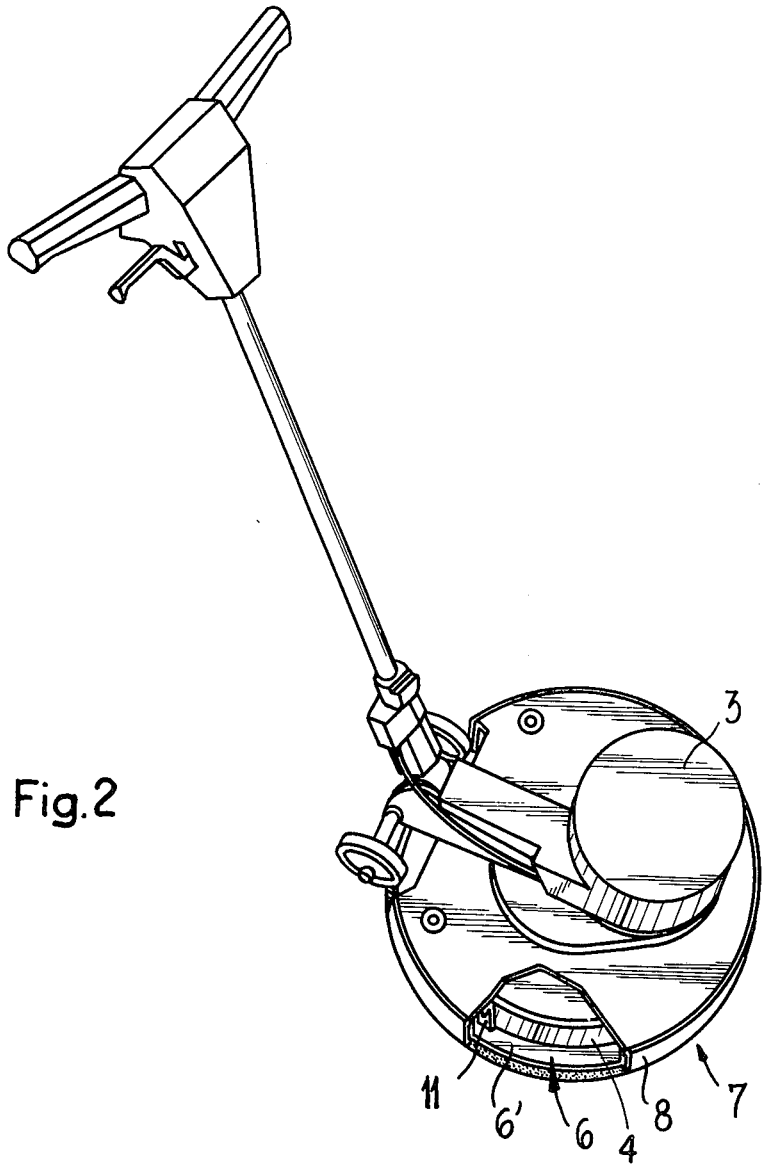
FIG. 2 illustrates the same machine portrayed in FIG. 1 but equipped with structure for carrying out the maintenance cleaning work.
Figure 3:
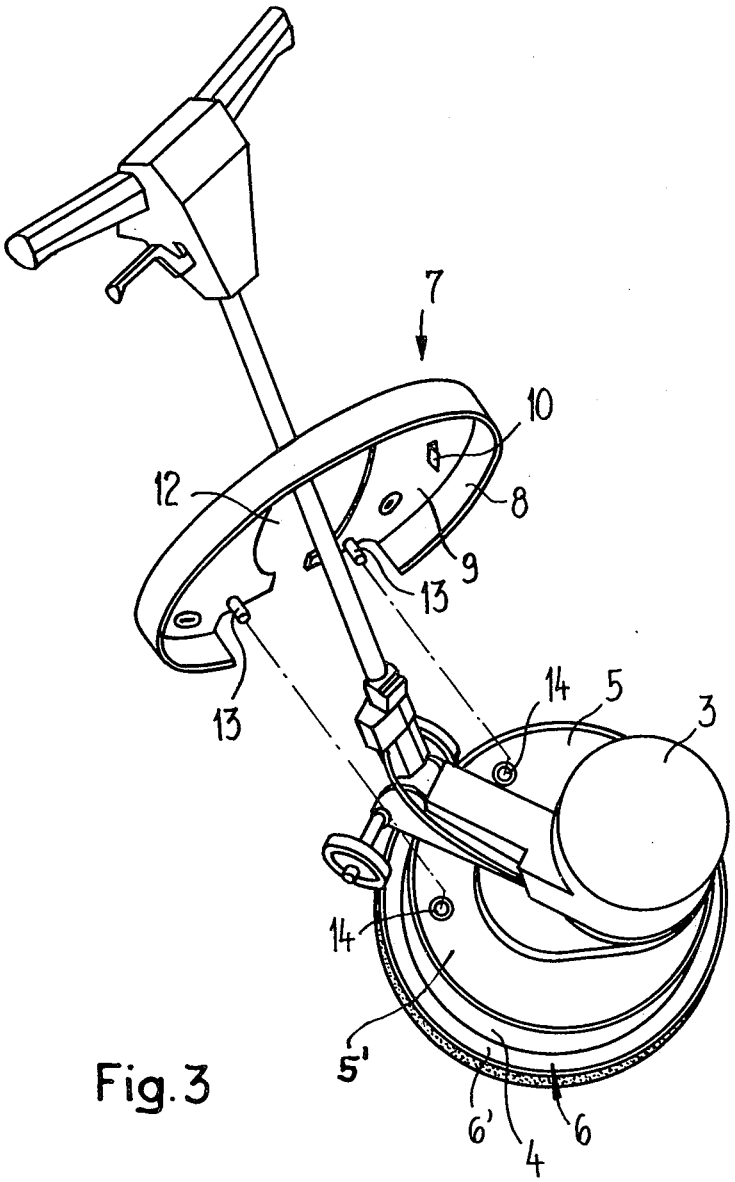
FIG. 3 illustrates the machine of FIG. 2 in a partially exploded view in order to reveal internal structure.

As best seen by referring to FIGS. 2 and 3, instead of using the work disk 2 it is possible with the aid of the previously mentioned detachable coupling to insert a work disk 6 which, in contrast to the work disk 2, possesses a wider marginal edge 6' which protrudes past the stop ring 4 and accordingly has a larger diameter. In all other respects the work disks 2 and 6 may be essentially of the same construction. A substantially pot-shaped ring stop, designated in its entirety by reference character 7, and associated with this work disk 6, has a stop or check ring 8 which is accommodated in its diameter to the larger size diameter work disk 6, and which stop ring 8 in the working position of the ring stop 7 (FIG. 2) is located around the stop ring 4 above the edge 6' of the work disk 6. The end wall 9 of the ring stop or stop member 7 bears against the wall 5 of the machine housing 5' and the stop rings 4 and 8 are centered relative to one another by means of centering projections 10 (FIG. 3) and 11 (FIG. 2) respectively, arranged at the end wall 9 and which engage about the outside of the stop ring 4. The end wall 9 is equipped with a recess 12 for piercingly receiving therethrough and accommodating therein parts of the machine housing which protrude past the wall 5. This end wall furthermore carries plug-in or insertable pins 13 or equivalent structure which can positively engage with sleeves 14 (FIG. 3) formed of rubber or a suitable plastic, and which sleeves are secured at the wall 5 of the machine housing 5'. In this way it is possible to securely hold in its working position, as shown in FIG. 2, the ring stop 7.

The output of the drive motor 3 is dimensioned such that for the primary or thorough cleaning work, i.e. for the heavier cleaning work there is available the required specific power or output related to the surface of the smaller work disk 2. If the smaller work disk 2 is exchanged for the larger work disk 6, then, the specific output drops to a valve which is adequate for the maintenance work, and the given motor output is completely usefully applied to the floor over a larger working surface. Consequently, the motor output calculated for the thorough cleaning work is transformed during the maintenance cleaning work into an hourly output which can be considerably greater than that of a maintenance cleaning machine which is only provided for use for this purpose. Consequently, the user of the equipment has a two-fold gain since he can get by with a single machine, which beneficially during the daily maintenance work is capable of reducing the working times and therewith the operating costs of the worker which are forever always increasing more and more.

While there is shown and described present preferred embodiments of the invention, it is to be distinctly understood that the invention is not limited thereto but may be otherwise variously embodied and practiced within the scope of the following claims Accordingly, what is claimed is:

1. A floor treating machine capable of being supported at the floor to be treated by means of a work disk, said work disk being arranged adjacent a substantially ring-shaped stop, the improvement comprising: said machine possessing a machine housing, said machine being provided with two work disks of different diameter which are selectively insertable at least partially into the machine housing, one of said work disks defining a smaller diameter work disk and the other of said work disks defining a larger diameter work disk, a separate substantially ring-shaped stop provided for each such different diameter work disk, the ring-shaped stop provided for the smaller diameter work disk defining a smaller ring-shaped stop relative to the other ring-shaped stop provided for the larger diameter work disk defining a larger ring-shaped stop, and at least the ring-shaped stop provided for the smaller diameter work disk being fixedly secured to said machine housing.

2. The floor treating machine as defined in claim 1, further including means for detachably securing the larger ring-shaped stop for the larger work disk at the machine housing.

3. The floor treating machine as defined in claim 2, wherein the larger diameter ring-shaped stop comprises a stop ring member which surrounds the smaller ring-shaped stop.

4. The floor treating machine as defined in claim 3, wherein the larger ring-shaped stop is arranged to be supported at the smaller ring stop.

5. The floor treating machine as defined in claim 4, wherein the larger ring-shaped stop possesses a substantially pot-shaped configuration and has an end wall which is supported at the smaller ring-shaped stop.

6. The floor treating machine as defined in claim 5, wherein the larger ring-shaped stop and said machine housing have cooperating means for centering said larger ring-shaped stop.

7. The floor treating machine as defined in claim 6, wherein said centering means comprises said machine housing having holes, the larger ring-shaped stop having centering projections and plug-in pins provided at the end face of said larger ring-shaped stop, said centering projections engaging about the smaller ring-shaped stop, and said plug-in pins being insertable into said holes of the machine housing.

* * * * *